US006575273B1

(12) United States Patent
Bergkvist et al.

(10) Patent No.: US 6,575,273 B1
(45) Date of Patent: Jun. 10, 2003

(54) BAG WITH TWO CONVEX LIDS

(75) Inventors: Håkan Bergkvist, Bromma (SE); Elisabet Broms, Täby (SE)

(73) Assignee: Baby Björn AB, Danderyd (SE)

( * ) Notice: Subject to any disclaimer, the term of this patent is extended or adjusted under 35 U.S.C. 154(b) by 0 days.

(21) Appl. No.: 09/926,750

(22) PCT Filed: Jul. 7, 2000

(86) PCT No.: PCT/SE00/01456

§ 371 (c)(1),
(2), (4) Date: Dec. 12, 2001

(87) PCT Pub. No.: WO01/05265

PCT Pub. Date: Jan. 25, 2001

(30) Foreign Application Priority Data

Jul. 16, 1999 (SE) ..... 9902720

(51) Int. Cl.[7] ..... A45C 5/00; A45C 5/12
(52) U.S. Cl. ..... 190/114; 190/111; 190/903
(58) Field of Search ..... 190/111–114, 903, 190/106

(56) References Cited

U.S. PATENT DOCUMENTS

| | | | | | |
|---|---|---|---|---|---|
| 2,213,821 | A | * | 9/1940 | McCurdy | 190/111 |
| 2,562,499 | A | * | 7/1951 | Lifton | 190/113 X |
| 2,672,962 | A | * | 3/1954 | Keirsey | 190/124 |
| 3,117,607 | A | * | 1/1964 | Siegel | 190/112 X |
| 4,098,376 | A | * | 7/1978 | Pelavin | 190/113 |
| 4,194,628 | A | | 3/1980 | Campos | 206/570 |
| 4,753,329 | A | * | 6/1988 | Choy | 190/111 |
| 5,105,919 | A | * | 4/1992 | Bomes et al. | 190/111 X |
| 5,749,447 | A | * | 5/1998 | Hersh et al. | 190/112 |

FOREIGN PATENT DOCUMENTS

| | | | | |
|---|---|---|---|---|
| DE | 88106 | | 11/1895 | |
| DE | 553 428 | | 6/1932 | |
| FR | 2 480 579 | | 10/1981 | |
| GB | 14070 | | 7/1904 | |
| GB | 585845 | * | 2/1947 | 190/111 |
| SU | 1757609 | * | 8/1992 | 190/112 |
| WO | 87/02227 | | 4/1987 | |

* cited by examiner

*Primary Examiner*—Sue A. Weaver
(74) *Attorney, Agent, or Firm*—Jacobson Holman PLLC

(57) ABSTRACT

A bag comprising a body (3) which has a lid (1, 2) on at least one of its two mutually opposing sides, wherewith the bottom edge of the lid is hinged to the bottom part of the body, wherein the lid (1, 2), which is substantially rigid, has an outwardly arched outer surface which is adapted to lie tangentially to the underlying bag supporting surface (55) at a distance from the area in which the bag (3) is supported by said surface (55) when the lid (1, 2) has been opened out. When in contact with the underlying supporting surface, the rim of the lid pitches a plane that defines with the underlying supporting surface (55) an angle that is greater than 5°. The bag includes means (12) adapted for limiting the maximal angle to which the lid can be opened relative to the body to a value at which the lid will lie tangentially to the bag supporting surface (55).

9 Claims, 3 Drawing Sheets

BAG WITH TWO CONVEX LIDS

BACKGROUND OF THE INVENTION

1. Field of the Invention

The present invention relates to a bag of the kind defined in the preamble of claim 1.

The present invention relates to a bag having a body which is provided on at least one of its mutually opposite sides with a lid which is hingedly connected at its lower edge to the bottom part of the body, wherein the lid is substantially rigid and has an outwardly arched outer surface that is formed to lie tangential to the underlying bag supporting surface at a distance from the area in which the bag is supported by the supporting surface when the lid is open.

2. Description of the Related Art

The invention thus relates to a bag that includes a body which has two hinged lids disposed on respective opposite sides thereof. The mutually facing surfaces of said lids and body have pockets and/or fasteners for various implements, consumable articles or supplies, etc. The bag can be used beneficially for accessories associated with the care of infants, for instance pacifiers, feeding bottles, napkins, diapers, skincare agents, etc.

The bag body is adapted to stand stably on a horizontal, flat supporting surface and extends generally perpendicular to this plane. The body has a bottom surface and the lids are hinged to mutually opposing edges thereof. The lids can be folded out from the bag body to rest on said supporting surface with the body standing upright on said surface.

The bag includes means for restricting the maximum angle to which the lids can be opened relative to the body.

WO 87/02227 teaches a bag of this particular kind, where the body comprises a rigid partition wall in the bag, and where the opening limiting means have the form of cords fixedly connected to respective edges of the partition wall and the lids extending parallel with the lid hinge axes, in their longitudinal midway region. The cords have a length which enables the two lids to lie flat on the underlying supporting surface, whereas the partition wall stands upright on said surface when the cords are stretched.

U.S. Pat. No. 4,194,628 teaches a case that includes a body which has storage spaces that are open towards the case lids, wherewith the outsides of the lids and the bottom of the body lie in a common plane (the supporting plane) in the opened state of the case.

SUMMARY OF THE INVENTION

One object of the invention is to provide a bag that will stand stably on a horizontal, underlying supporting surface even when one of its two lids is opened out to an angle in which the rim of the lid lies in a plane that defines an angle of at least 5° with the supporting surface, and preferably an angle of 10–40°, and more preferably an angle of 10–30° therewith.

In the case of a bag that comprises a body and two hingedly connected lids, a further object of the invention is to provide comfortable access to a storage space in the bag when the lids are closed against the body.

These objects are achieved with the bag according to the present invention.

According to one embodiment of the invention preferred at present, the body has on each of two mutually opposite sides a lid that is substantially rigid and generally panel-like in construction and that has an outwardly curved or arched outer surface as seen in a plane normal to the hinge axes of the lids, such that the lids impart an aesthetically attractive, gently curved appearance to the bag, such as to form a storage space in respective lids inwardly of their rim plane. The lid opening limiting means suitably has the form of flexible pleated walls that connect the side edges of the body to the side edges of respective lids. The lids are adapted to support against the underlying bag supporting plane at a significant distance from the hinge axes of respective lids, when the rim plane of the arched lid defines an angle of, e.g., 10–70° with the bag supporting plane. The lid opening limiting means may be adapted to define the angle to which the lid can be opened from the bag body and at which the lid will lie tangential to said supporting plane. Because the lid can also support against the supporting plane outside the body surface supported by said supporting surface, the risk of the bag toppling is reduced when solely one lid is opened out to said inclined angle to the underlying supporting surface and carries a heavy load.

The body includes a generally rectangular bottom plate that has support feet in respective corners thereof. The body has a generally tubular shape, whose cross-section is preferably substantially partitioned by a panel that is generally perpendicular to the bottom plate of the bag and functions to stabilise the generally tubular part of said body. In addition to the bottom plate, the tubular part of the body also includes a narrower top plate and top-plate connecting walls, which are preferably trapezoidal in shape, such that the tubular part of said body will have end planes that slope upwards/inwards towards a body symmetry plane.

Thus, the rim planes of the lids will be located above the bottom plate of the bag when the lids are closed, so that the centre of gravity of the lids and their contents will be displaced in a direction towards the bottom plate of the bag and preferably to a position inwardly of the bottom-plate supporting surface lying against the underlying support surface.

In one embodiment of the bag, the upper part of the body has an opening which permits user access to the bag interior whilst the lids are closed against the body. This access opening enables the user to reach frequently used articles, such as comforters or pacifiers, feeding bottles, and the like. A flap or the like is suitably hinged on the bag, preferably on one of its lids, so that it can be dropped over the opening so as to cover the same. The free end of the flap may include means for releasably fastening the flap on the opposite side of the opening.

The opening can extend along a selected part of the upper edge of the bag, and two mutually opposing edge parts of the opening may suitably be formed by rim parts of the bag lids, these edge and rim parts optionally being recessed or apertured to impart a purposeful width to the opening.

The lids are suitably connectable to the bag body through the medium of zip fasteners that extend from the hinge connection of the lids to the bottom plate of the body up to the longitudinal midway plane of the bag or, when an opening is provided through the upper bag plate, to the edge of the opening. The bag is preferably provided with a shoulder strap that connects with two mutually opposing, preferably trapezoidal bag walls.

The invention will now be described in more detail by way of example with reference to the accompanying drawings.

DETAILED DESCRIPTION OF THE PREFERRED EMBODIMENTS

Figure 1:
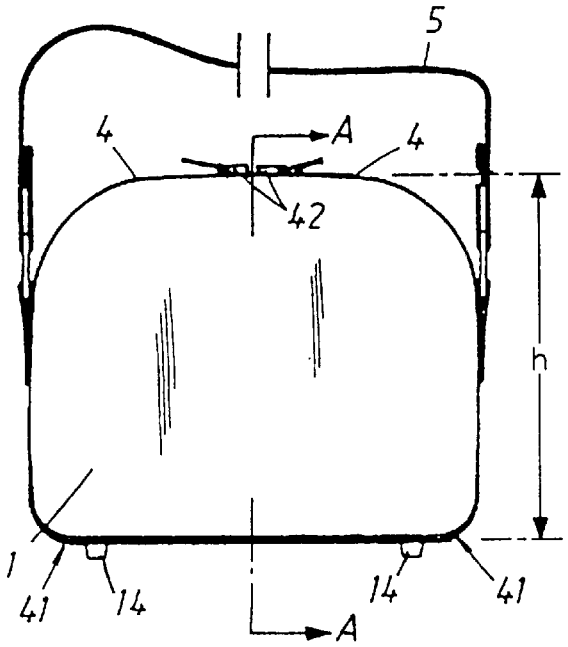
FIG. 1 is a side view of a bag constructed in accordance with the invention.
Figure 2:
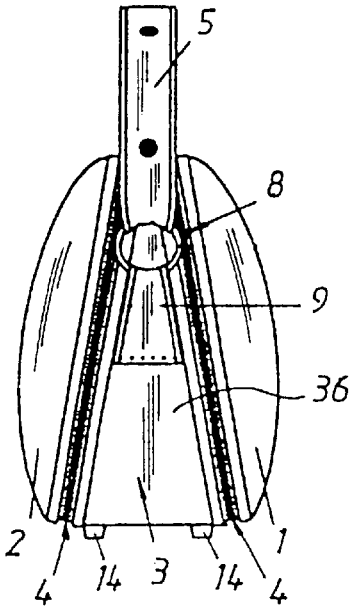
FIG. 2 is an end view of the bag shown in FIG. 1.
Figure 3:
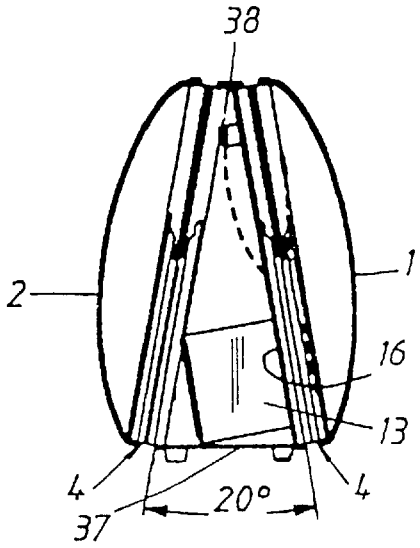
FIG. 3 illustrates a section taken on the line A—A in FIG. 1.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

FIGS. 1–5 illustrate a bag that comprises a body 3 which includes a generally rectangular bottom plate 37 which has corner-mounted support feet 14 for supporting the bag on an underlying supporting surface 55. The body has two trapezoidal walls 36 whose side edges include an angle of 20°. The upper part 38 of the body has the form of a narrow, generally rectangular plate disposed centrally opposite the bottom plate 37. The plates 37, 38 and the walls 36 are mutually connected to form a tubular body part that is partitioned by a generally vertically orientated wall plate 16 which, in the illustrated embodiment, lies generally in the plane that is pitched by the body opening edge against which the rims of respective lids connect when the lids are closed.

The lids 1, 2 are hinged to respective longitudinal edges of the bottom plate 37. The lids 1, 2 are arched as seen in a plane normal to the lid hinge connections 39, which may consist of flexible band material. Zip fasteners 4 extend from the ends 41 of the hinges 39 up to the lid-determined symmetry plane of the bag, where the guide bodies 42 of the zip fasteners are located adjacent each other. The bag defined by the body and the lids is also substantially symmetrical relative to a plane centrally between the closed lids.

Each body wall 36 is provided, via an attachment 9, with a ring 8 to which a shoulder strap 5 is connected.

Provided at each body wall 36 is a preferably pleated structure 12 that connects between the body 3 and respective lids 1, 2. The lids 1, 2 are arched so as to lie tangential to the supporting surface 55 on which the feet rest, when the pleated structure 12 is extended, at the same time as the rims of respective lids 1, 2 define an angle $\alpha$ with the underlying supporting surface, the angle being about 25° in the illustrated case, although it may be in the order of 5–45°. The pleated structure 12 preferably extends from the hinges 39 up to at least one-third of the height h of the lid and the body respectively.

Figure 4:
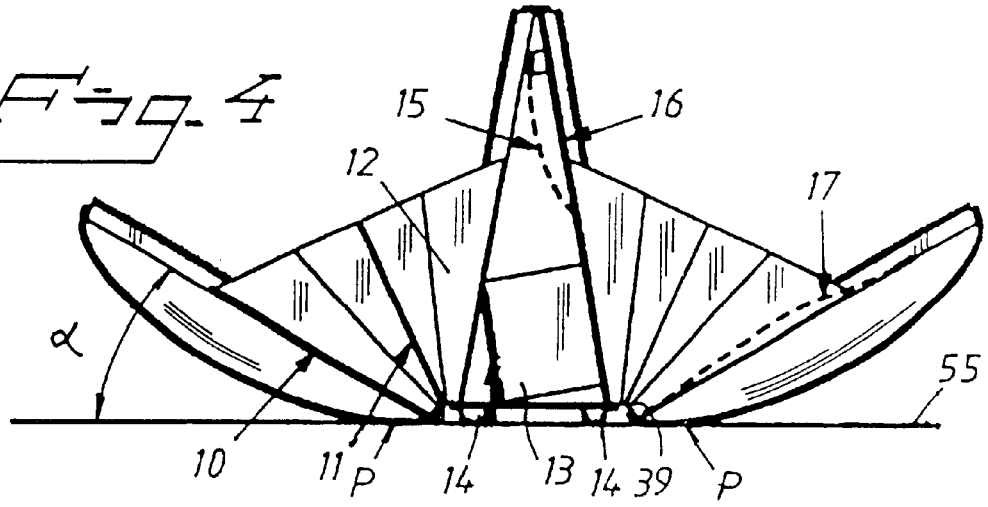
FIG. 4 shows the bag of FIG. 3 with the lids opened out.

It will be seen from FIG. 4 that the lids 1, 2 are supported by the underlying supporting surface 55 at a point P which is spaced significantly from the support feet 14. In this regard, the inner surface of the lid is intended to slope downwards and inwards towards the body, at least in respect of that part of the lid which is located outside the lid support point P. As will be seen from FIG. 4, the distance between P and the adjacent support foot is roughly the same as the distance between respective support feet and may vary widely. For instance, said distance may be in the region of 0.2 to two times the distance between respective support feet.

Because the walls 36 are trapezoidal in shape, the centre of gravity of the lids 1, 2 and their contents will be displaced towards/into the support area defined by the feet 14, wherewith the bag will remain stable even when the lids 1, 2 are closed against the body 3.

Figure 5:
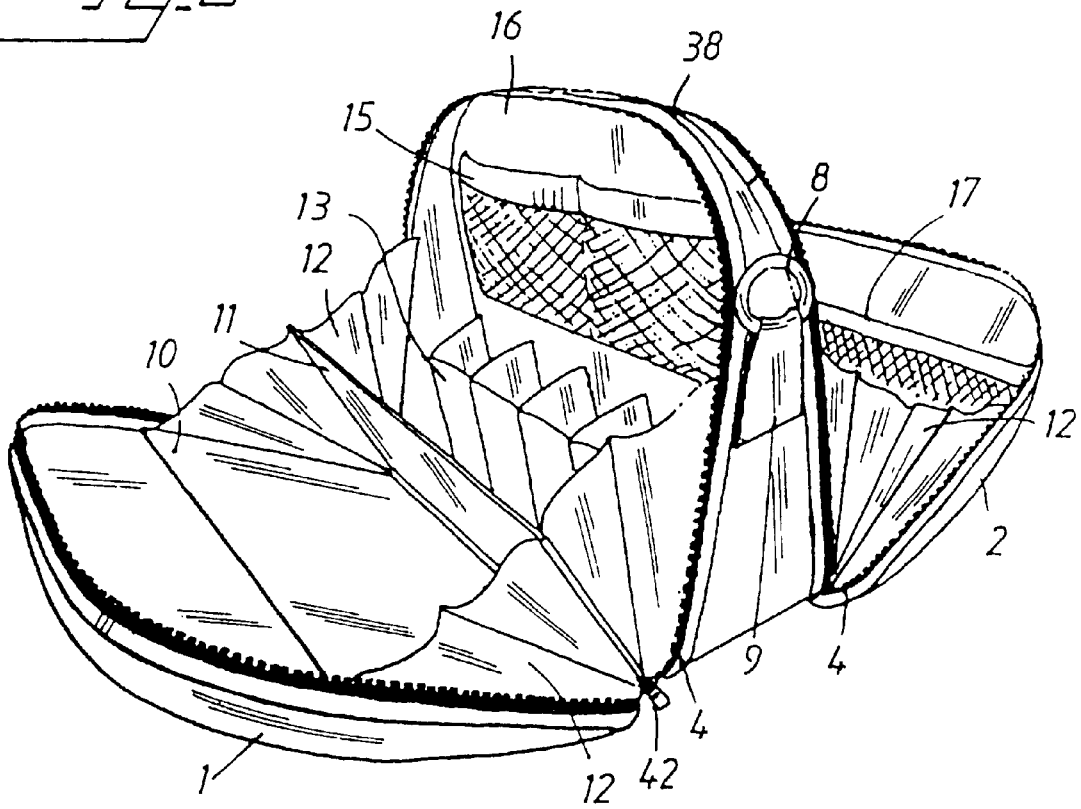
FIG. 5 is a perspective view of the bag with the lids opened out.

Referring now to FIG. 5, it will be seen that a panel 11 is inserted between the centre parts of the bellows-like structure 12, and that a plane-rigid panel 10 that extends over a part of the height of the lid 1 also extends in the proximity of the rim plane of the lid 1 so that a storage pocket can also be established between the inside of the lid 1 and the panel 10. A row of bottle holders 13 are provided on one side of the panel, inwardly of the end plane of the body. Upwardly open storage pockets 15 are provided on the upper part of the panel 16, on the side thereof facing towards the panel 11. The lid 2 is provided with a storage pocket 17 on its inner surface.

Figure 6:
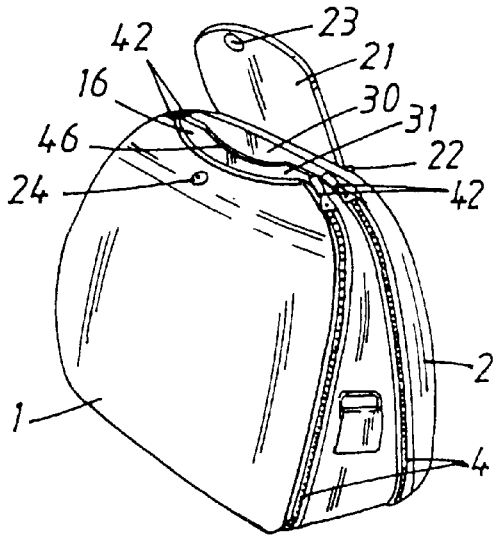
FIG. 6 is a perspective view of one variant of the bag.
Figure 7:
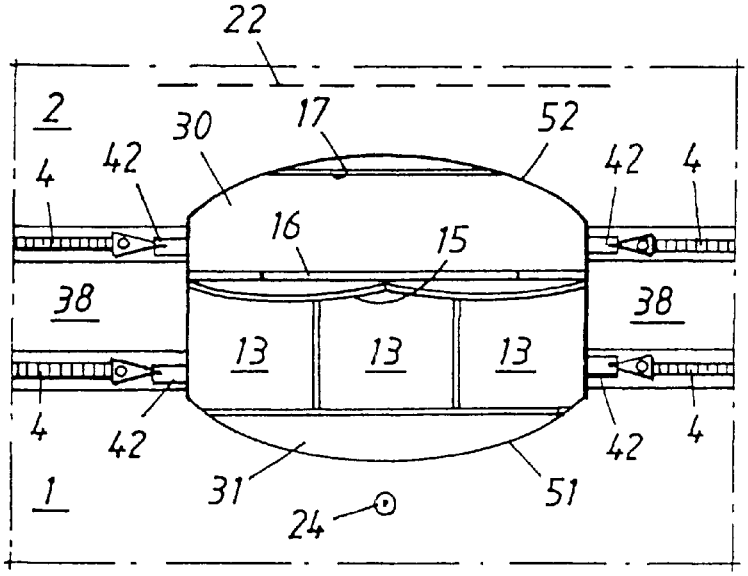
FIG. 7 is a detailed plan view of the subject of FIG. 6.

As will be seen from FIGS. 6 and 7, the body top plate has an opening or a discontinuation in its longitudinal midway region, so as to form an opening 30, 31 for access to the bag interior when the lids 1, 2 are closed against the body 3. The body panel 16 may include an opening 46 in its upper edge part, to facilitate access to the bag interior via the openings 30, 31. It will be seen from FIGS. 6 and 7 that the rims of the lids 1, 2 may have openings 51, 52 that function to widen the openings 30, 31. FIG. 7 shows that the zip fastener 4 is terminated at opposite ends of the openings 30, 31. It will also be seen that a flap or like device 21 is hinged to the bag, suitably on one lid 2. The flap/lid 21 may be rigid and have a cross-sectional configuration that conforms with the general cross-sectional configuration of the upper part of the closed bag. Furthermore, the flap/lid 21 may be pivotally connected via a hinge 2. The flap/lid 21 may also be provided with a fastener 23, for instance a press-stud catch that can be caused to engage with a corresponding catch part 24 on the lid 1 in the closed position of the flap 21.

The inventive bag is primarily intended for use as an infant-care bag that can be carried readily and used comfortably in producing and replacing pacifiers, feeding bottles and other frequently used items. The bag is also intended to provide comfortable access to its interior when the lids are opened out, as is the normal case, wherewith the lids and the body together define deep pockets that minimise the risk of an article that may have fallen down towards the pocket from falling out of the opened bag. The opened lids have a maximum extended position in which they extend obliquely down towards the underlying supportive surface. Because the lids are tangential to the supportive surface at a considerable distance from the bag supporting area on said supportive surface, the bag obtains improved stability when one lid is in its open position.

Although the invention has been described with reference to one embodiment thereof, it will be understood that this embodiment can be modified in several respects.

For instance, the access opening 30, 31 can be utilized regardless of the angle at which the lids 1, 2 rest against the underlying supporting surface when opened out. It will also be understood that the bag can be used for accessories other than those related to infant care. The hinges 39 will suitably lie on the level of the plate 37, i.e., at a height of about 1–2 cm above the supporting plane of the feet 14.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A bag comprising a body which is provided on at least one of its mutually opposite sides with a lid which is hingedly connected at its lower edge to the bottom part of the body, a height of said lid being greater than a width of said bottom part as measured between said mutually opposite sides, wherein the lid is substantially rigid and has an outwardly arched outer surface that is formed to lie tangential to the underlying bag supporting surface at a distance from the area in which the bag is supported by said supporting surface when said lid is open, the rim of said lid defining with said supporting surface an angle that is greater than 5° when the lid is in contact with said supporting surface, said bag including a flexible wall structure between side-edge parts of the body and respective side-edge parts of said lid so that, when in an open position, the lid will form together with said body and said flexible walls a pocket that has downwardly sloping walls and with which the lid-defined wall slopes downward and inward when the bag rests on said supporting surface, said flexible wall structure restricting the maximum angle to which the lid can be opened relative to the body, to a value at which the lid becomes tangential to the bag supporting surface when said flexible wall structure is fully extended.

2. The bag according to claim 1, wherein the flexible walls have a pleated, concertina-like structure that extends from a region of the lid hinge connection to said body and up to at least one-third of a height of the lid and the body respectively.

3. The bag according to claim 1, wherein an upper part of the body includes an opening through which a bag interior can be accessed when the lid is closed against the body.

4. The bag according to claim 3, wherein said bag includes a flap which functions to cover the opening, said flap being hinged to said bag.

5. The bag according to claim 3, wherein a free edge of the lid includes a cut-out that defines a part of the access opening.

6. The bag according to claim 1, wherein edges of the lid are connectable to the body by means of an associated zip fastener that extends from respective ends of the lid hinge connection to said body along a rim of the lid and up to an upper longitudinal midway area of an edge of the bag.

7. bag according to claim 6, wherein the zip fasteners are terminated at corresponding end edges of the opening.

8. The bag according to claim 1, wherein the body is provided with a lid on each of its two mutually opposing sides.

9. The bag according to claim 8, wherein the body includes a bottom plate, a top plate and two separate walls that interconnect the top and bottom plates, a wall extending between the bottom plate and the walls of said body up to a region of the top plate of said body, with edge parts of the body that lie proximal to the lids lying in planes that converge upwards and form a joining plane with an opening edge of the lids.

* * * * *